US009132466B2

(12) United States Patent
Tsuda

(10) Patent No.: US 9,132,466 B2
(45) Date of Patent: Sep. 15, 2015

(54) ROLLER HEMMING DEVICE

(75) Inventor: Satoshi Tsuda, Toyota (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 294 days.

(21) Appl. No.: 13/988,666

(22) PCT Filed: Nov. 22, 2010

(86) PCT No.: PCT/JP2010/070834

§ 371 (c)(1),
(2), (4) Date: May 21, 2013

(87) PCT Pub. No.: WO2012/070108

PCT Pub. Date: May 31, 2012

(65) Prior Publication Data

US 2013/0247639 A1 Sep. 26, 2013

(51) Int. Cl.
*B21D 39/02* (2006.01)
*B21D 19/04* (2006.01)

(52) U.S. Cl.
CPC ..... *B21D 39/023* (2013.01); *B21D 19/043* (2013.01)

(58) Field of Classification Search
CPC .... B21D 39/02; B21D 39/021; B21D 39/023; B21D 19/043; B21D 7/002; Y10T 29/53791
See application file for complete search history.

(56) References Cited

U.S. PATENT DOCUMENTS

| | | | | |
|---|---|---|---|---|
| 6,477,879 | B1 | 11/2002 | Sawa | |
| 2005/0086989 | A1 * | 4/2005 | Holmgren et al. | 72/220 |
| 2006/0075797 | A1 * | 4/2006 | Baulier et al. | 72/220 |
| 2008/0092618 | A1 | 4/2008 | Hasegawa et al. | |
| 2011/0170946 | A1 | 7/2011 | Schneegans et al. | |

FOREIGN PATENT DOCUMENTS

| | | | |
|---|---|---|---|
| JP | S62-212025 | | 9/1987 |
| JP | H07-314054 | | 12/1995 |
| JP | 2675347 | B2 | 11/1997 |
| JP | 2002-035865 | A | 2/2002 |
| JP | 2008-100272 | A | 5/2008 |
| JP | 2010-515584 | A | 5/2010 |
| JP | 2010-194568 | A | 9/2010 |
| WO | 00/13816 | A1 | 3/2000 |

* cited by examiner

*Primary Examiner* — Debra Sullivan
(74) *Attorney, Agent, or Firm* — Kenyon & Kenyon LLP

(57) ABSTRACT

Disclosed is a roller hemming device, which is capable of excellent hemming even when a subject to be hemmed is located in a relatively narrow place, and reducing maintenance frequency. Specifically disclosed is a roller hemming device, which includes a preliminary bending roller for performing preliminary bending of a work, a final bending roller for performing final bending of the work, and an arm for setting attitudes of the preliminary bending roller and the final bending roller at desired positions and angles. The preliminary bending roller has an axis inclined with respect to a horizontal direction and is arranged at such a position not to come in contact with the work during the final bending. The final bending roller is formed in a circular truncated cone, has an axis which is inclined with respect to the horizontal direction so that, during the final bending, a large diameter surface thereof faces toward the work and a processing surface thereof is horizontally positioned, and is arranged at such a position not to come in contact with the work during the preliminary bending. The preliminary bending roller and the final bending roller are arranged along a top-bottom direction, each having a processing point located in a vicinity of an axis of the arm.

3 Claims, 6 Drawing Sheets

ROLLER HEMMING DEVICE

This is a 371 national phase application of PCT/JP2010/070834 filed 22 Nov. 2010, the contents of which are incorporated herein by reference.

FIELD OF THE INVENTION

The present invention relates to a roller hemming device for hemming a work by use of a roller.

BACKGROUND OF THE INVENTION

Conventionally, a roller hemming device is widely known that is configured to perform bending (preliminary bending) of a standing flange of a work such as a door subassembly of a car at a predetermined angle by use of a roller, and then to perform bending (final bending) of the flange at a final angle by use of the roller.

As shown in FIG. 5, a work W as a subject to be hemmed by the roller hemming device is a door subassembly. The work W includes a door panel W10 having a plurality of plates, and a door frame W20 projecting upward from the door panel W10 to configure a window frame. When the roller hemming device hems the beltline (the top end of the door panel W10) of the work W, the roller hemming device located in the window frame may interfere with the door frame W20. Therefore, it is difficult to roll a roller along the beltline of the work W.

As shown in FIG. 6, the door panel W10 includes an outer panel W11 which has a standing flange (the right end part of the outer panel W11 in FIG. 6) and which is placed on a bottom die B, an outer reinforcement W12 which is arranged on the outer panel W11 and to the left of the flange, an inner reinforcement W13 which is arranged at a predetermined distance above the outer reinforcement W12, and an inner panel W14 which is placed on the inner reinforcement W13. Since the beltline of the work W has the narrow clearance between the outer panel W11 and the outer reinforcement W12, and the inner reinforcement W13 and the inner panel W14, the roller hemming device interferes with the work W. Therefore, it is difficult for the roller hemming device to hem the beltline of the work W.

Note that FIG. 6 is an end view taken along the line A-A of FIG. 5.

When the beltline of the work W as mentioned above is hemmed, in order to avoid interference with the work W, a roller hemming device having a roller with the small outside diameter and the long length in the axial direction needs to be used (for example, see JP 2008-100272 A).

However, as shown in FIG. 7, in a roller hemming device 100 having a roller 101, which is the roller as mentioned above, with the small outside diameter and the long length in the axial direction, since flexure occurs at the time of the hemming because of the large interval between a part of the roller 101 coming in contact with the flange of the outer panel W11 to hem the work W, and an attachment member 102 to which the roller 101 is attached, it is difficult to hem the work W to a desired thickness. Moreover, since the big moment acts on the attachment member 102 at the time of the hemming, the problem occurs that the attachment member 102 is deformed for example. As a result, the time and cost required for the maintenance of the roller hemming device 100 increase.

On the other hand, because of the small outside diameter of the roller 101, when the roller 101 sequentially bends the flange of the outer panel W11, the elongation amount of the flange partly increases. As a result, the problem occurs that the flange is formed in waves for example.

CITATION LIST

Patent Literature

Patent Literature 1: JP 2008-100272 A

SUMMARY OF INVENTION

Problems to be Solved by the Invention

The objective of the present invention is to provide a roller hemming device capable of hemming even when a subject to be hemmed is located in a narrow place, and reducing maintenance frequency.

Means for Solving the Problems

The first embodiment of the present invention is a roller hemming device, which includes a preliminary bending roller for performing preliminary bending of a work, a final bending roller for performing final bending of the work, an attachment member to which the preliminary bending roller and the final bending roller are rotatably attached, and an arm for setting orientations of the preliminary bending roller and the final bending roller at desired positions and angles, in which the attachment member includes a first bent part to which the preliminary bending roller is attached and a second bent part to which the final bending roller is attached, the first bent part being extended downward in an orientation inclined with respect to a vertical direction so as to move into proximity with the work during the preliminary bending and to move out of proximity with the work during the final bending, the second bent part being extended downward in an orientation inclined oppositely to an inclination of the first bent part with respect to the vertical direction so as to move into proximity with the work during the final bending and to move out of proximity with the work during the preliminary bending, the first bent part and the second bent part being arranged at different positions in the vertical direction, in which the preliminary bending roller is arranged nearer to the work than the first bent part during the preliminary bending, has an axis which is inclined with respect to a horizontal direction so that a processing surface of the preliminary bending roller moves into proximity with the work at the time of the preliminary bending, and is arranged at such a position not to come in contact with the work during the final bending, in which the final bending roller is formed in a circular truncated cone, is arranged nearer to the work than the second bent part during the final bending, has an axis which is inclined with respect to the horizontal direction so that, during the final bending, a large diameter surface of the final bending roller faces toward the work and a processing surface of the final bending roller is horizontally positioned, and is arranged at such a position not to come in contact with the work during the preliminary bending, and in which the preliminary bending roller and the final bending roller are arranged along the vertical direction, each having a processing point located in a vicinity of an axis of the arm.

Advantageously, the embodiment of the roller hemming device has a backup roller which rotates depending on the rotation of the final bending roller, in which the backup roller is arranged so as to come in contact with a surface of the final bending roller opposite to the processing surface of the final bending roller in a diametrical direction.

Preferably, the embodiment of the roller hemming device has a means for equalizing a processing pressure during the preliminary bending or the final bending of the work by biasing the preliminary bending roller and the final bending roller toward the work at a constant pressure and by absorbing a counterforce.

Effects of the Invention

The present invention makes it possible to perform hemming even when a subject to be hemmed is located in a narrow place, and to reduce maintenance frequency.

DETAILED DESCRIPTION

Figure 1:
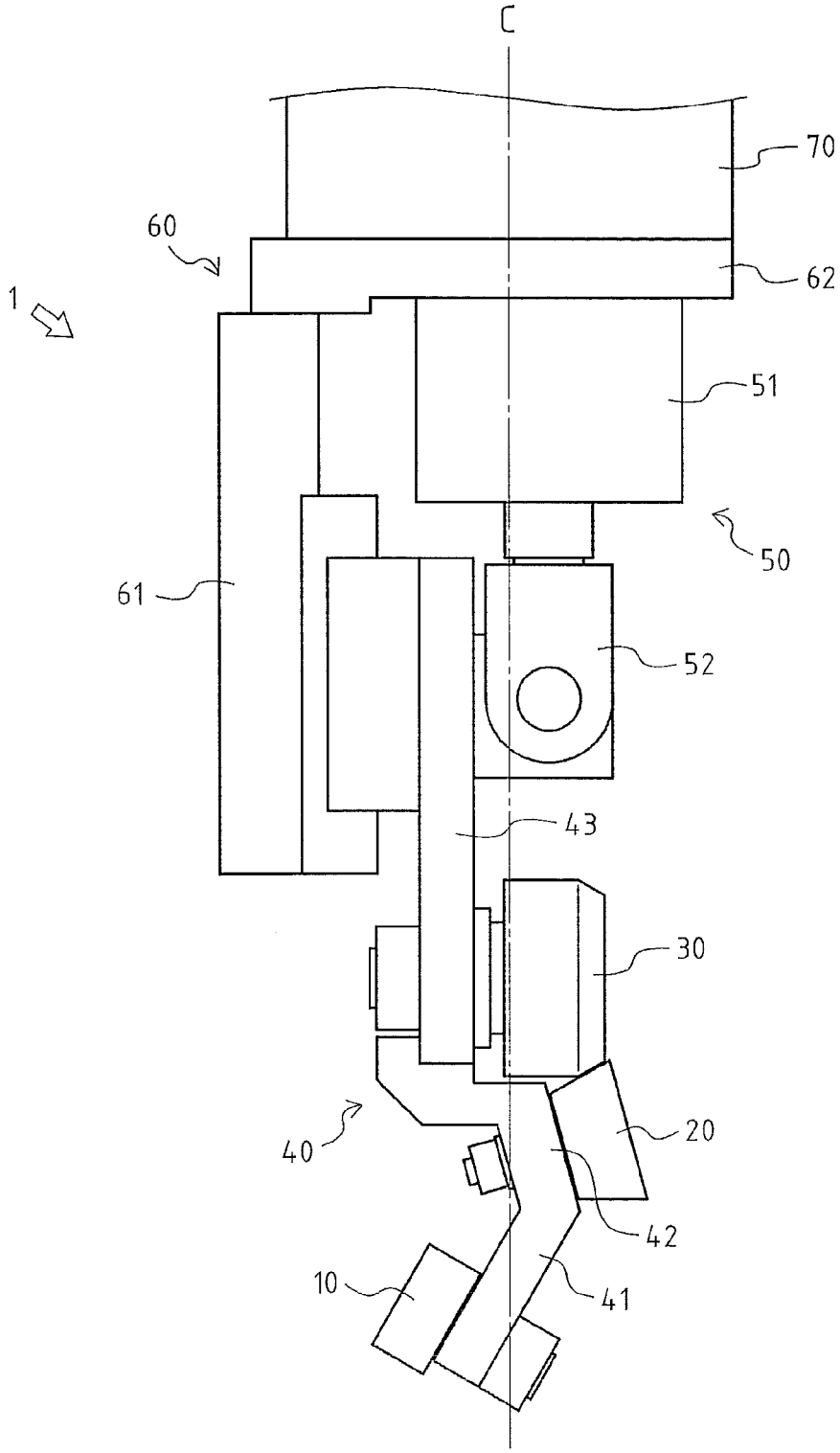
FIG. 1 illustrates a roller hemming device according to the present invention.

With reference to FIG. 1, a roller hemming device 1 as an embodiment of a roller hemming device according to the present invention is described below.

The roller hemming device 1 is a device for hemming a beltline of a work W.

Figure 6:
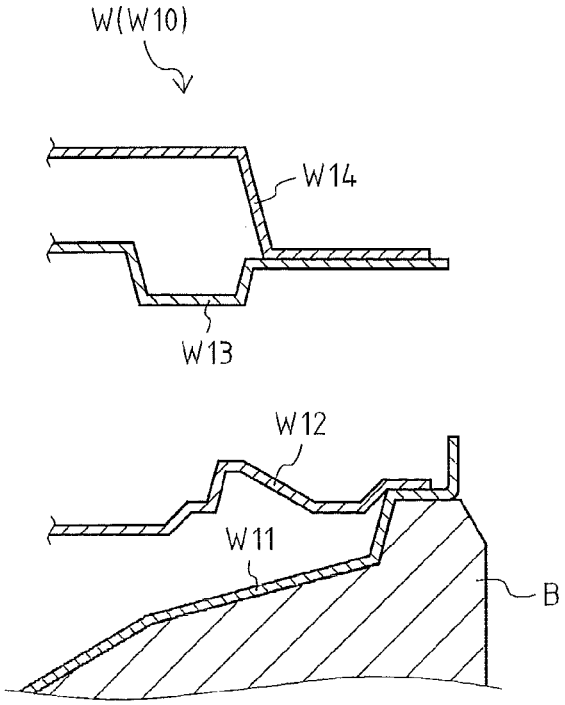
FIG. 6 illustrates a beltline of the work, and is an end view taken along the line A-A of FIG. 5.
Figure 7:
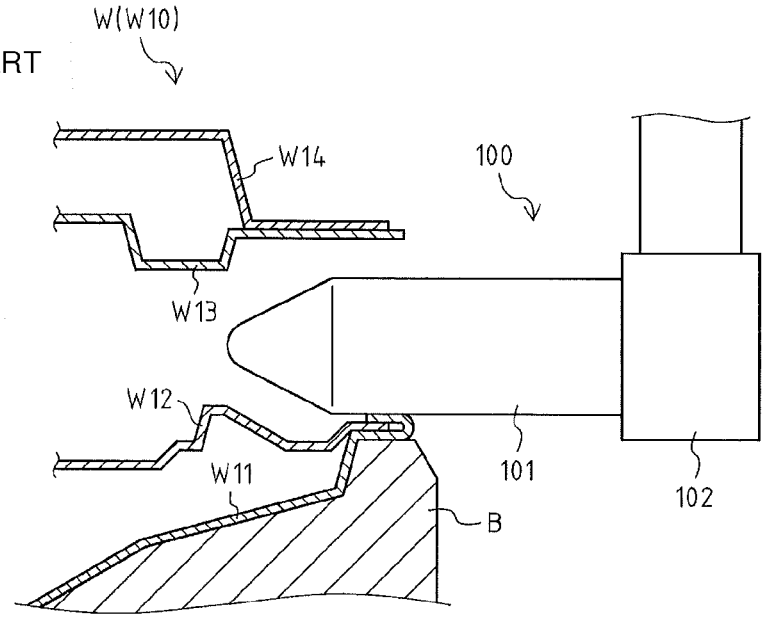
FIG. 7 RELATED ART
FIG. 7 shows how a conventional roller hemming device hems the work.

The work W is a door subassembly fabricated in a step for manufacturing cars. The work W includes an outer panel W11 which has a standing flange the right end part of the outer panel W11 in FIG. 6) and which is placed on a bottom die B, an outer reinforcement W12 which is arranged on the outer panel W11 and to the left of the flange, an inner reinforcement W13 which is arranged at a predetermined distance above the outer reinforcement W12, and an inner panel W14 which is placed on the inner reinforcement W13 (see FIG. 6).

The bottom die B is a member on which the work W is placed so that the outer panel W11 comes in contact with the bottom die B.

Note that a top-bottom direction and a right-left direction in FIG. 1 are defined as a top-bottom direction and a right-left direction of the roller hemming device 1, respectively. The top-bottom direction in FIG. 1 corresponds to the vertical direction.

As shown in FIG. 1, the roller hemming device 1 has a preliminary bending roller 10 for preliminarily bending the work W, a final bending roller 20 for finally bending the work W, a backup roller 30 which rotates depending on the rotation of the final bending roller 20, an attachment member 40 to which the rollers 10, 20, 30 are rotatably attached, an air cylinder 50 which biases the attachment member 40 at a predetermined pressure, a supporting member 60 which supports the attachment member 40 slidably and which supports the air cylinder 50, and an arm 70 which is fixed to the supporting member 60 and which is capable of setting the attitudes of the preliminary bending roller 10 and the final bending roller 20 at desired positions and angles.

The roller hemming device 1 preliminarily bends the work W a plurality of times by rolling the preliminary bending roller 10 along the beltline of the work W via the arm 70, and then finally bends the work W by rolling the final bending roller 20 along the beltline of the work W via the arm 70, thus hemming the work W.

The preliminary bending roller 10 is a roller for performing "preliminary bending" which means bending the flange of the outer panel W11 of the work W at a predetermined angle. The preliminary bending roller 10 is formed in a circular cylinder, and is rotatably attached to the bottom end part of the attachment member 40 so that the axis of the preliminary bending roller 10 forms a predetermined angle with respect to the horizontal direction. The preliminary bending roller 10 is arranged on the left side of the bottom end part of the attachment member 40.

The final bending roller 20 is a roller for performing "final bending" which means bending the flange of the outer panel W11 of the work W passed through the preliminary bending at a final angle (such an angle that the flange comes in contact with the top surface of the outer reinforcement W12). The final bending roller 20 is rotatably attached to the middle part of the attachment member 40 in the top-bottom direction so that the axis of the final bending roller 20 forms a predetermined angle with respect to the horizontal direction. The final bending roller 20 is formed in a circular truncated cone, and the large diameter surface thereof faces to the right. Specifically, the final bending roller 20 inclines so that the processing surface thereof (the bottom end of the outer circumferential surface) is horizontally positioned, and is attached to the attachment member 40. The final bending roller 20 is arranged on the side (right side) of the attachment member 40 opposite to the preliminary bending roller 10 in the right-left direction.

Thus, the final bending roller 20 and the preliminary bending roller 10 are arranged at the upper side and lower side, and are attached to the right side and left side of the attachment member 40, respectively.

The backup roller 30 comes in contact with the outer circumferential surface of the final bending roller 20, and rotates depending on the rotation of the final bending roller 20. The backup roller 30 is formed in substantially a circular cylinder, and is rotatably attached to the attachment member 40 so that the axis of the backup roller 30 is horizontally positioned. The backup roller 30 is formed so that the outer circumferential surface thereof inclines from the right edge to the middle part thereof along the outer circumferential surface of the final bending roller 20. The backup roller 30 is arranged so that the bottom end of the inclining part of the outer circumferential surface thereof comes in contact with the top end of the outer circumferential surface of the final bending roller 20. In other words, the backup roller 30 is arranged on the top of the final bending roller 20 so as to come in contact with the surface of the final bending roller 20 opposite to the processing surface thereof in a diametrical direction of the final bending roller 20.

This makes it possible to apply a force toward the flange to the final bending roller 20 which moves out of proximity with the flange by a counterforce when the final bending roller 20 performs the final bending to the flange of the outer panel W11. Therefore, it becomes possible to prevent the final bending roller 20 from flexing at the time of hemming, and to hem the work W in a suitable thickness. Note that since the backup roller 30 rotates depending on the rotation of the final bending roller 20 at the time of hemming, the backup roller 30 does not impede the rotation of the final bending roller 20.

In the present embodiment, the backup roller 30 is arranged so that the axis thereof is horizontally positioned, but as long as the backup roller 30 can rotate depending on the rotation of the final bending roller 20, the backup roller 30 may be arranged so that the axis thereof is vertically positioned, for example.

The attachment member 40 is a member which has the shape extended in the top-bottom direction while being bent, and to which the rollers 10, 20, 30 are rotatably attached. The attachment member 40 has a first bent part 41 to which the preliminary bending roller 10 is attached, a second bent part 42 to which the final bending roller 20 is attached, and a straight part 43 to which the backup roller 30 is attached.

The first bent part 41 has the shape which is extended from the connection between the first bent part 41 and the second bent part 42 to the lower left according to the inclination angle of the preliminary bending roller 10 so as to form a predetermined angle with respect to the vertical direction. The preliminary bending roller 10 is attached to the left side of the extension end part of the first bent part 41, and the processing point of the preliminary bending roller 10 is located in the vicinity of the axis (the chain line C in FIG. 1) of the arm 70.

As used herein, the term "the axis of the arm 70" means a straight line extending, in the vertical direction, from the central part of the surface of the arm 70 coming in contact with the supporting member 60, namely, from the central part of the surface of the supporting member 60 pressed by the arm 70 at the time of hemming.

The second bent part 42 has the shape which is extended from the connection between the second bent part 42 and the straight part 43 to the lower right according to the inclination angle of the final bending roller 20 so as to form a predetermined angle with respect to the vertical direction. The extension end part of the second bent part 42 is connected with the base end part (top end part) of the first bent part 41. The second bent part 42 is extended so as to intersect the axis of the arm 70.

The final bending roller 20 is attached to the right side of the second bent part 42, and the processing point of the final bending roller 20 is located in the vicinity of the axis of the arm 70.

The straight part 43 has the shape extended straight in the top-bottom direction, and the bottom end part thereof is connected with the base end part (top end part) of the second bent part 42.

The backup roller 30 is attached to the lower part of the straight part 43, and is arranged on the right side of the straight part 43 so as to come in contact with the final bending roller 20.

Thus, in the attachment member 40, the first bent part 41 and the second bent part 42 are extended to the lower left and the lower right, respectively, so as to intersect the axis of the arm 70.

This makes it possible to hold the preliminary bending roller 10 and the final bending roller 20 inclined, and to locate the processing points of the preliminary bending roller 10 and the final bending roller 20 in the vicinity of the axis of the arm 70. Therefore, it is possible to prevent the flexure of the attachment member 40 caused by the moment occurring at the time of hemming according to a counterforce and a distance from the axis of the arm 70 in the horizontal direction, and to hem the work W in a suitable thickness.

As used herein, the term "the vicinity of the axis of the arm 70" means not only the area on the axis of the arm 70 but also the area around the axis of the arm 70, and means such an area that the moment occurring at the time of hemming according to a counterforce and a distance from the axis of the arm 70 in the horizontal direction is controlled to a minimum and that the roller hemming device 1 can hem the work W in a suitable thickness without the flexure of the attachment member 40.

The air cylinder 50 is an air cylinder for biasing the attachment member 40 downward at a predetermined pressure, and acts as a means for equalizing a processing pressure at the time of hemming. The air cylinder 50 has a fixed part 51 attached to the supporting member 60 and a movable part 52 capable of moving with respect to the fixed part 51 in the top-bottom direction.

The fixed part 51 supports the movable part 52, and biases the movable part 52 downward at a predetermined pressure with compressed air. The top end part of the fixed part 51 is fixed to the supporting member 60.

The movable part 52 consists of a piston and the like, and is supported by the fixed part 51 so as to move in the top-bottom direction. The movable part 52 is arranged on the right side of the straight part 43 of the attachment member 40, and is fixed to the upper part of the straight part 43.

Thus, in the air cylinder 50, the movable part 52 supported by the fixed part 51 is biased downward at a predetermined pressure by the compressed air. It follows from this that the preliminary bending roller 10 and the final bending roller 20 is biased downward at a predetermined pressure through the attachment member 40 fixed to the movable part 52. Moreover, strokes of the movable part 52 supported by the fixed part 51 absorbs a counterforce at the time of hemming.

This makes it possible to perform the preliminary bending of the work W with the preliminary bending roller 10 at a uniform pressure, and to perform the final bending of the work W with the final bending roller 20 at a uniform pressure.

The arm 70 is controlled so that each of the preliminary bending roller 10 and the final bending roller 20 arrives linearly at each of a plurality of predetermined points. Therefore, in a case where a subject to be hemmed by the roller hemming device 1 is not a straight part such as the beltline of the work W in the present embodiment but a curved part, a contact area between the preliminary bending roller 10 and the subject, and a contact area between the final bending roller 20 and the subject vary.

However, at the time of hemming, the preliminary bending roller 10 and the final bending roller 20 are biased downward at a constant pressure while the air cylinder 50 absorbs a counterforce, thus enabling to equalize the processing pressure, and to perform hemming uniformly without variation in the processing pressure even in a case where the subject to be hemmed is a curved part.

In the present embodiment, an air cylinder is adopted as the means for equalizing the processing pressure, but the present invention is not limited to this. An oil hydraulic cylinder, a spring or the like may be adopted as the means.

The supporting member 60 has a vertical part 61 extending in the top-bottom direction and a horizontal part 62 extending in the right-left direction, and is formed in substantially a L-shape in which the top end part of the vertical part 61 and the left end part of the horizontal part 62 are joined.

The vertical part 61 is arranged to the left of the straight part 43 of the attachment member 40, and supports the upper part of the straight part 43 slidably. The slide structure is not limited to the present embodiment, and an existing linear guide and the like may be adopted.

The horizontal part 62 is arranged on the top of the air cylinder 50, and supports the air cylinder 50. Specifically, the bottom end part of the horizontal part 62 and the top end part of the fixed part 51 of the air cylinder 50 are fixed.

Moreover, the top end part of the horizontal part 62 is fixed to the extremity (the bottom end part) of the arm 70.

Thus, in the supporting member 60, the vertical part 61 supports the attachment member 40 slidably, and the horizontal part 62 supports the air cylinder 50.

This enables the attachment member 40 fixed to the movable part 52 to move not in the right-left direction but only in the top-bottom direction depending on the movement of the movable part 52 of the air cylinder 50.

The arm 70 is a robotic arm which can be set at desired position and angle, and is attached to the top end part of the horizontal part 62 of the supporting member 60. The arm 70 can set the attitudes of the preliminary bending roller 10 and the final bending roller 20 at desired positions and angles through the supporting member 60 and the attachment member 40. The arm 70 causes the preliminary bending roller 10 or the final bending roller 20 to press the flange of the outer panel W11 of the work W, and to roll along the beltline of the work W. Thus, the work W is hemmed.

Figure 2:
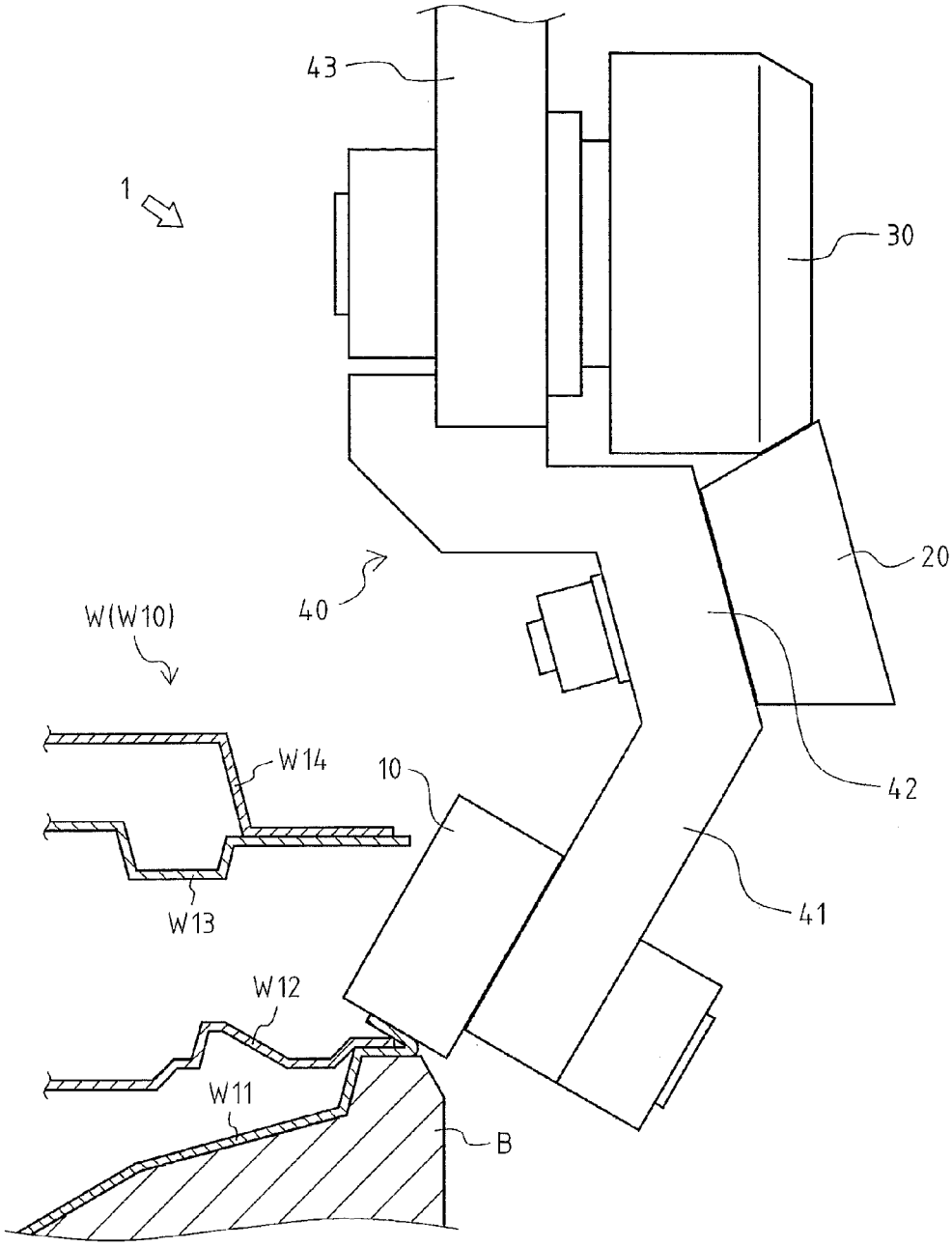
FIG. 2 shows how the roller hemming device preliminarily bends a work.
Figure 3A:
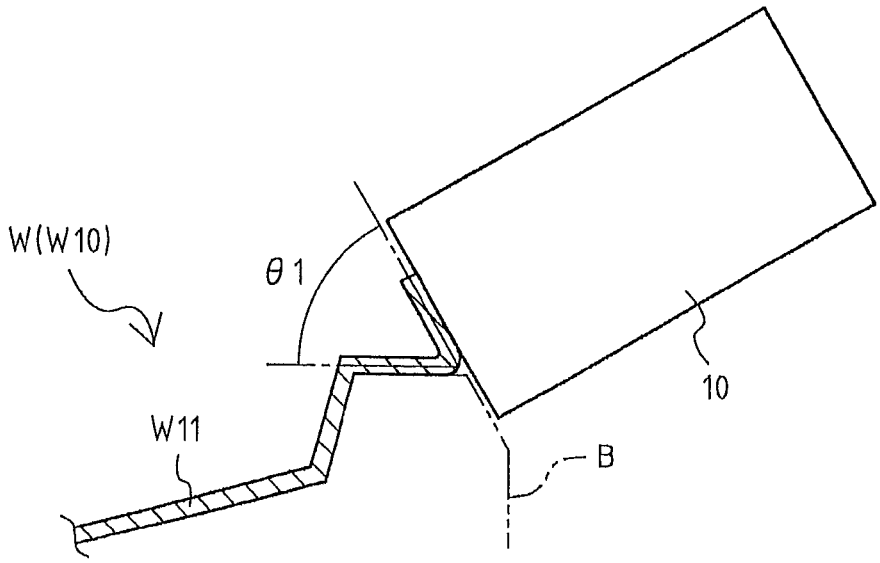
FIGS. 3(A) and 3(B) show how the work is preliminarily bended a plurality of times.
Figure 3B:
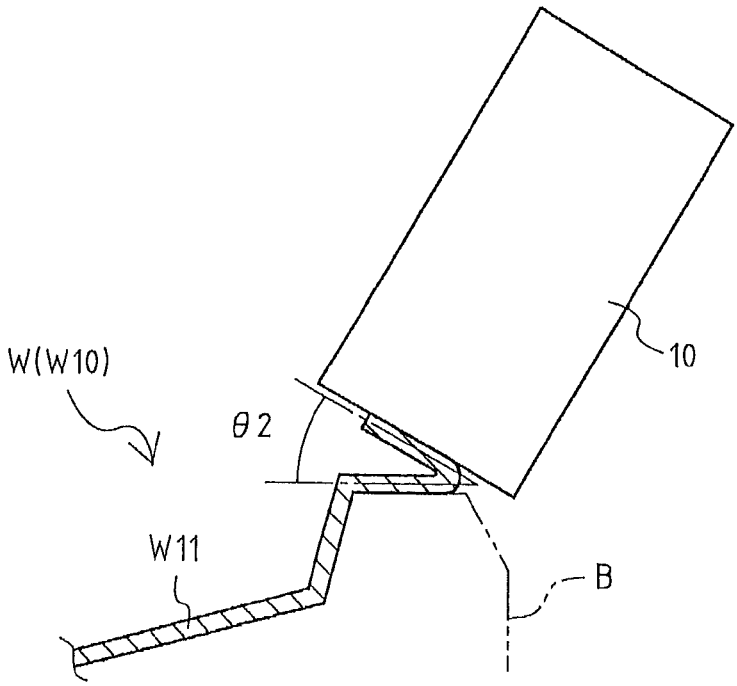
Figure 4:
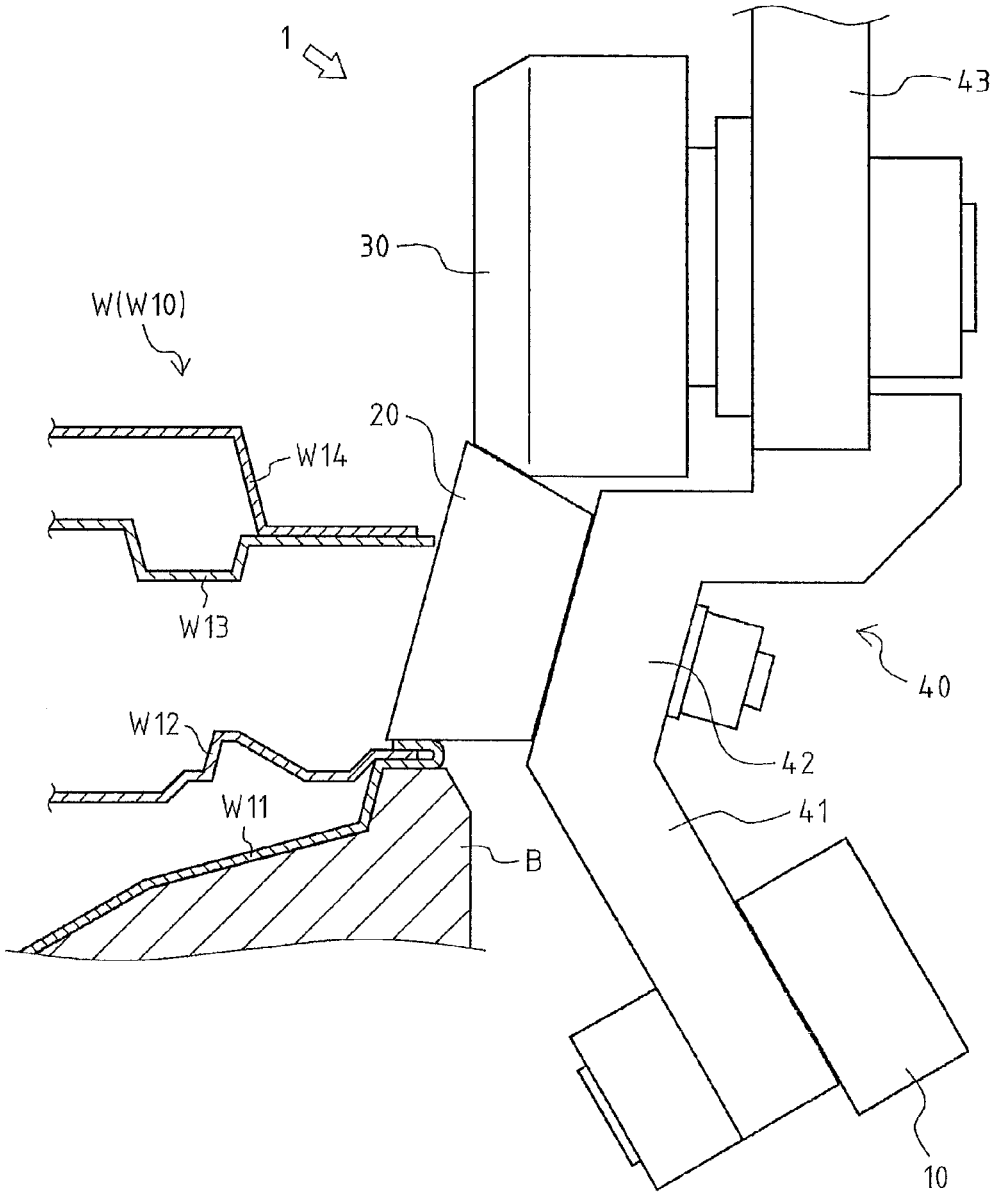
FIG. 4 shows how the roller hemming device finally bends the work.

With reference to FIGS. 2 to 4, the situation where the roller hemming device 1 hems the work W is described below.

First, the preliminary bending of the work W is performed.

As shown in FIG. 2, the lower part of the preliminary bending roller 10 is moved into the clearance between the outer panel W11 and the outer reinforcement W12, and the inner reinforcement W13 and the inner panel W14 in the beltline of the work W by the arm 70. The preliminary bending roller 10 presses the flange of the outer panel W11 of the work W, and bends the flange at the angle of the processing surface of the preliminary bending roller 10. Then, the preliminary bending roller 10 rolls along the beltline of the work W while pressing the flange, and thereby performs the preliminary bending of the whole flange.

As mentioned previously, since the attachment member 40 is bent, and the first bent part 41 of the attachment member 40 has the shape which is extended toward the flange in the lower left direction during the preliminary bending of the flange, the attachment member 40 holds the preliminary bending roller 10 inclined.

This makes it possible to move the preliminary bending roller 10 into the narrow clearance formed in the beltline of the work W without the preliminary bending roller 10 and the first bent part 41 interfering with the work W, and to excellently perform the preliminary bending of the flange. Additionally, this makes it possible to shorten the length of the preliminary bending roller 10 in the axial direction thereof. Therefore, it becomes possible to prevent the deformation of the attachment member 40, and to reduce the maintenance frequency of the roller hemming device 1 because the big moment does not act, at the time of hemming, on the part of the attachment member 40 to which the preliminary bending roller 10 is attached.

Moreover, since the second bent part 42 of the attachment member 40 has the shape which is extended to the lower right so as to move out of proximity with the flange during the preliminary bending of the flange, the second bent part 42 supports the final bending roller 20 on the opposite side to the preliminary bending roller 10 in the right-left direction.

This makes it possible to excellently perform the preliminary bending of the flange without the final bending roller 20 and the second bent part 42 interfering with the work W.

The preliminary bending roller 10 performs the preliminary bending of the work W a plurality of times. In the present embodiment, the preliminary bending of the work W is performed twice.

As shown in FIG. 3(A), in the first preliminary bending, the arm 70 set the preliminary bending roller 10 at such an angle that an angle formed between the processing surface of the preliminary bending roller 10 and the horizontal plane is θ1. Then, by performing the preliminary bending of the work W as mentioned above, the work W is formed in which an angle (hereinafter called "a preliminary bending angle") formed between the flange and the other part of the outer panel W11 is θ1.

As shown in FIG. 3(B), in the second preliminary bending, the arm 70 set the preliminary bending roller 10 at such an angle that an angle formed between the processing surface of the preliminary bending roller 10 and the horizontal plane is θ2 (θ2<θ1). Then, by performing the preliminary bending of the work W as mentioned above, the work W is formed in which the preliminary bending angle is θ2.

Note that, for the purposes of description, FIGS. 3(A) and 3(B) illustrate only the outer panel W11 of the work W and the preliminary bending roller 10 of the roller hemming device 1.

In the roller hemming device 1, the final bending roller 20 and the preliminary bending roller 10 are arranged at the upper side and lower side respectively, and the processing points of the final bending roller 20 and the preliminary bending roller 10 are arranged in the vicinity of the axis of the arm 70.

Figure 5:
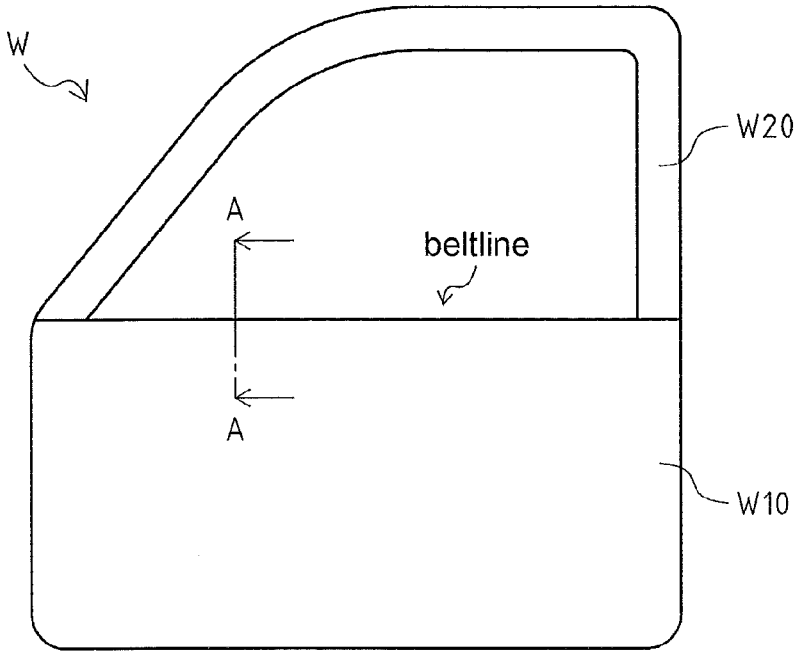
FIG. 5 illustrates a door subassembly as the work.

This makes it possible to control the width (length in the right-left direction) of the roller hemming device 1 to a minimum, and, when the roller hemming device 1 inclines and performs the preliminary bending of the work W, to select the inclination angle of the roller hemming device 1 from a wider range without the roller hemming device 1 interfering with the door frame W20 (see FIG. 5). In addition, the inclination of the preliminary bending roller 10 makes it possible to select the preliminary bending angle from a wider range (e.g. 20 to 90 degrees). Therefore, it becomes possible to perform the preliminary bending of the work W a plurality of times as mentioned above, and, compared with the case where the preliminary bending is performed once or the case only the final bending is performed without the preliminary bending, to reduce a processing amount of the flange per time to control poor quality such as local elongation of the flange to a minimum.

In the present embodiment, the preliminary bending roller 10 is formed in a circular cylinder, but the present invention is not limited to this. As long as the preliminary bending angle can be set at a desired value, the preliminary bending roller 10 may be formed in a circular truncated cone as with the final bending roller 20.

The preliminary bending angle may be calculated as mentioned below.

Based on an elongation rate of the flange calculated from the diameter of the preliminary bending roller 10 and a processing amount of the flange during the preliminary bending, an elongation amount of the flange during the preliminary bending is calculated, and the processing amount of the flange such that the elongation amount does not exceed a limit value based on an empirical rule is calculated.

Then, the number of times of the preliminary bending is calculated from the calculated processing amount of the flange and the angle (90 degrees in the present embodiment) of the flange before being hemmed, and as a result, the preliminary bending angle is obtained.

Second, the final bending of the work W is performed.

As shown in FIG. 4, by rotating the arm 70 approximately 180 degrees horizontally, the roller hemming device 1 is in the left-right reverse attitude relative to the attitude during the preliminary bending. Then, the lower part of the final bending roller 20 is moved into the clearance between the outer panel W11 and the outer reinforcement W12, and the inner reinforcement W13 and the inner panel W14 in the beltline of the work W by the arm 70. The final bending roller 20 presses the flange of the outer panel W11 of the work W with the processing surface thereof horizontal, and bends the flange so that the flange is horizontally positioned (so that the flange comes in contact with the top surface of the outer reinforcement W12). Then, the final bending roller 20 rolls along the beltline of the work W while pressing the flange, and thereby performs the final bending of the whole flange.

Note that the pressure of the final bending roller 20 against the work W during the final bending is larger than the pressure of the preliminary bending roller 10 against the work W during the preliminary bending. Therefore, arranging the backup roller 30 on the top of the final bending roller 20 prevents the final bending roller 20 from flexing.

As mentioned previously, the final bending roller 20 is formed in a circular truncated cone, and the large diameter surface thereof faces toward the work W during the final bending. Accordingly, the processing surface of the final bending roller 20, and the large diameter surface thereof form an acute angle.

This makes it possible to move the final bending roller 20 into the narrow clearance formed in the beltline of the work W without the final bending roller 20 interfering with the work W, and to excellently perform the final bending of the flange. Additionally, this makes it possible to increase the outside diameter of the final bending roller 20, and thereby to control poor quality such as local elongation of the flange to a minimum and to improve the durability of the final bending roller 20. Additionally, this makes it possible to shorten the length of the final bending roller 20 in the axial direction thereof. Therefore, it becomes possible to prevent the deformation of the attachment member 40, and to reduce the maintenance frequency of the roller hemming device 1 because the big moment does not act, at the time of hemming, on the part of the attachment member 40 to which the final bending roller 20 is attached.

Moreover, since the attachment member 40 is bent, and the second bent part 42 of the attachment member 40 has the shape extended toward the flange in the lower left direction during the final bending of the flange, the attachment member 40 holds the final bending roller 20 inclined.

This makes it possible to keep the processing surface of the circular truncated cone-shaped final bending roller 20 horizontal, and to excellently perform the final bending of the flange without the final bending roller 20 and the second bent part 42 interfering with the work W.

Moreover, since the first bent part 41 of the attachment member 40 has the shape which is extended to the lower right so as to move out of proximity with the flange during the final bending of the flange, the first bent part 41 supports the preliminary bending roller 10 on the opposite side to the final bending roller 20 in the right-left direction.

This makes it possible to perform the final bending of the flange without the preliminary bending roller 10 and the first bent part 41 interfering with the work W.

INDUSTRIAL APPLICABILITY

The present invention is applied to a roller hemming device for hemming a subject in a narrow place such as a beltline of a door panel.

REFERENCE SIGNS LIST

1: roller hemming device
10: preliminary bending roller
20: final bending roller
30: backup roller
40: attachment member
41: first bent part
42: second bent part
43: straight part
50: air cylinder
51: fixed part
52: movable part
60: supporting member
61: vertical part
62: horizontal part
70: arm

The invention claimed is:

1. A roller hemming device comprising:

a preliminary bending roller for performing preliminary bending of a work;

a final bending roller for performing final bending of the work;

an attachment member to which the preliminary bending roller and the final bending roller are rotatably attached; and an arm for setting orientations of the preliminary bending roller and the final bending roller at desired positions and angles, wherein the attachment member includes a first bent part to which the preliminary bending roller is attached and a second bent part to which the final bending roller is attached, the first bent part being extended downward in an orientation inclined with respect to a vertical direction so as to move into proximity with the work during the preliminary bending and to move out of proximity with the work during the final bending, the second bent part being extended downward in an orientation inclined oppositely to an inclination of the first bent part with respect to the vertical direction so as to move into proximity with the work during the final bending and to move out of proximity with the work during the preliminary bending, the first bent part and the second bent part being arranged at different positions in the vertical direction, the preliminary bending roller is arranged nearer to the work than the first bent part during the preliminary bending, has an axis which is inclined with respect to a horizontal direction so that a processing surface of the preliminary bending roller moves into proximity with the work at the time of the preliminary bending, and is arranged at such a position not to come in contact with the work during the final bending, the final bending roller is formed in a circular truncated cone, is arranged nearer to the work than the second bent part during the final bending, has an axis which is inclined with respect to the horizontal direction so that, during the final bending, a large diameter surface of the final bending roller faces toward the work and a processing surface of the final bending roller is horizontally positioned, and is arranged at such a position not to come in contact with the work during the preliminary bending, and the preliminary bending roller and the final bending roller are arranged along the vertical direction, each having a processing point located in a vicinity of an axis of the arm.

2. The roller hemming device according to claim 1, further comprising:

a backup roller which rotates depending on the rotation of the final bending roller, wherein the backup roller is arranged so as to come in contact with a surface of the final bending roller opposite to the processing surface of the final bending roller in a diametrical direction.

3. The roller hemming device according to claim 1, further comprising:

a means for equalizing a processing pressure during the preliminary bending or the final bending of the work by biasing the preliminary bending roller and the final bending roller toward the work at a constant pressure and by absorbing a counterforce.

* * * * *